US010344768B2

(12) United States Patent
Cardon et al.

(10) Patent No.: US 10,344,768 B2
(45) Date of Patent: Jul. 9, 2019

(54) GAS COMPRESSION PROCESS WITH INTRODUCTION OF EXCESS REFRIGERANT AT COMPRESSOR INLET

(71) Applicant: L'Air Liquide, Societe Anonyme pour l'Etude et l'Exploitation des Procedes Georges Claude, Paris (FR)

(72) Inventors: Guillaume Cardon, Poissy (FR); Antony Correia Anacleto, Creteil (FR); Benoit Davidian, Saint Maur des Fosses (FR); Francois-Xavier Lemant, Roissy en Brie (FR); Quentin Saniez, Paris (FR); Jean-Pierre Tranier, L'Hay-les-Roses (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 474 days.

(21) Appl. No.: 15/102,940

(22) PCT Filed: Dec. 2, 2014

(86) PCT No.: PCT/FR2014/053117
§ 371 (c)(1),
(2) Date: Jun. 9, 2016

(87) PCT Pub. No.: WO2015/086951
PCT Pub. Date: Jun. 18, 2015

(65) Prior Publication Data

US 2017/0211578 A1 Jul. 27, 2017

(30) Foreign Application Priority Data

Dec. 10, 2013 (FR) ..... 13 62362

(51) Int. Cl.
*F04D 17/12* (2006.01)
*F04D 27/00* (2006.01)
(Continued)

(52) U.S. Cl.
CPC ..... *F04D 27/009* (2013.01); *F04D 17/12* (2013.01); *F04D 27/006* (2013.01);
(Continued)

(58) Field of Classification Search
CPC .. F25J 3/04018; F25J 2205/04; F25J 2230/02; F04D 27/006
See application file for complete search history.

(56) References Cited

U.S. PATENT DOCUMENTS

2002/0092286 A1 7/2002 Hatamiya et al.
2008/0247885 A1* 10/2008 Hagen ..... F02C 7/1435 417/244
2012/0103188 A1* 5/2012 Stinessen ..... E21B 43/34 95/24

FOREIGN PATENT DOCUMENTS

EP 0 781 909 7/1997
EP 2 610 465 7/2013
(Continued)

OTHER PUBLICATIONS

International Search Report and Written Opinion for PCT/FR2014/053117, dated Mar. 10, 2015.

*Primary Examiner* — Woody A Lee, Jr.
(74) *Attorney, Agent, or Firm* — Justin K. Murray

(57) ABSTRACT

A process for compressing a gaseous fluid comprising a step (a) of injecting refrigerant during which a refrigerant substance is sprayed into the gaseous fluid to be compressed, and also a compression step (b), during which the passage of said gaseous fluid loaded with refrigerant substance is forced through said compressor in order to compress said gaseous fluid, the mass flow rate (Q3) of the refrigerant substance
(Continued)

injected into the gaseous fluid represents between 1% and 5% of the mass flow rate of the gaseous fluid to be compressed, and the refrigerant substance is sprayed in the form of particles having a maximum dimension of less than or equal to 25 pm, and preferably less than or equal to 10 pm.

18 Claims, 1 Drawing Sheet

(51) Int. Cl.
*F25J 3/04* (2006.01)
*F04D 29/70* (2006.01)

(52) U.S. Cl.
CPC ..... *F04D 29/706* (2013.01); *F25J 3/04018* (2013.01); *F25J 2205/04* (2013.01); *F25J 2230/02* (2013.01)

(56) References Cited

FOREIGN PATENT DOCUMENTS

| | | |
|---|---|---|
| FR | 2 946 099 | 12/2010 |
| JP | 2008 190335 | 8/2008 |

* cited by examiner

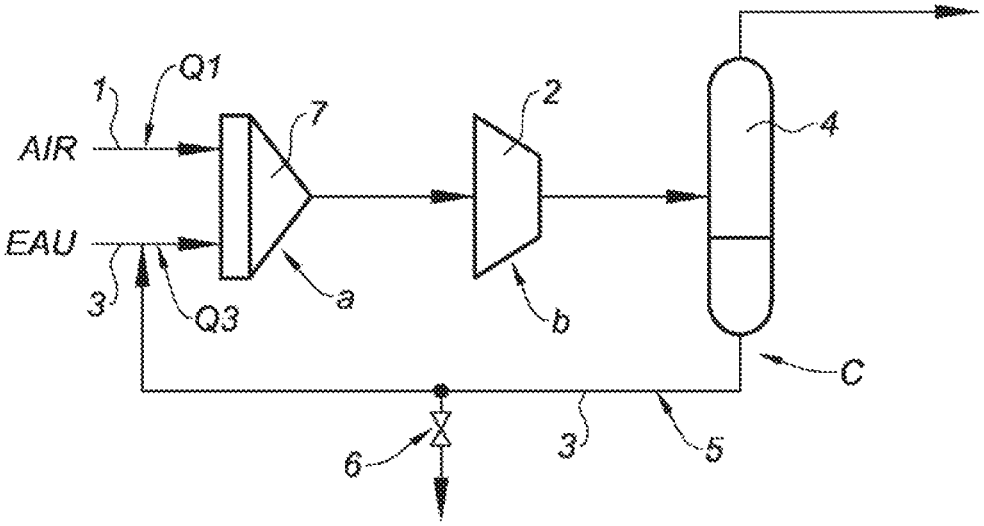
1
Q1
AIR
EAU
3
Q3
7
a
2
b
4
C
6
3
5

GAS COMPRESSION PROCESS WITH INTRODUCTION OF EXCESS REFRIGERANT AT COMPRESSOR INLET

CROSS REFERENCE TO RELATED APPLICATIONS

This application is a § 371 of International PCT Application PCT/FR2014/053117, filed Dec. 2, 2014, which claims the benefit of FR1362362, filed Dec. 10, 2013, both of which are herein incorporated by reference in their entireties.

TECHNICAL FIELD OF THE INVENTION

The present invention relates to the general field of processes for compressing gaseous fluids, and more particularly to processes for compressing air.

BACKGROUND OF THE INVENTION

It is known practice to inject into a stream of air to be compressed, upstream of the compressor, water droplets intended to limit the heating of the air/water mixture during compression, which makes it possible to render said compression more isothermal and thus to increase its efficiency.

SUMMARY OF THE INVENTION

That being so, the targeted objects of the invention are directed toward further improving the efficiency of compression of a gaseous fluid, and toward proposing for this purpose a novel compression process that affords a significant gain in yield relative to the known processes, while at the same time conserving relative simplicity of implementation.

The targeted objects of the invention are achieved by means of a process for compressing a gaseous fluid, comprising a step (a) of injecting refrigerant, during which a refrigerant substance is sprayed into the gaseous fluid to be compressed, and also a compression step (b), during which said gaseous fluid charged with refrigerant substance is forced to pass through a compressor so as to compress said gaseous fluid, said process being characterized in that the mass delivery rate of the refrigerant substance injected into the gaseous fluid represents between 1% and 5% of the mass delivery rate of the gaseous fluid to be compressed, and in that the refrigerant substance is sprayed in the form of particles with a maximum size of less than or equal to 25 μm.

Advantageously, by combining the particular conditions for injecting the refrigerant that are intrinsic to the invention, and more particularly by combining an appropriate amount of refrigerant substance with particularly fine spraying of said refrigerant substance, the compression performance can be optimized.

The inventors have in fact found that the combined optimization of these injection parameters make it possible to obtain genuine synergism, simultaneously affording two notably beneficial effects on the efficiency of the compressor.

Firstly, spraying of the refrigerant substance in relatively large amount in the form of microparticles, or microdroplets, creates a particularly homogeneous two-phase medium whose mean density, and more particularly whose "homogeneous density", is greater than that of the gaseous fluid alone, which makes it possible to give the gaseous fluid thus charged with refrigerant substance and entrained by the compressor high kinetic energy, and consequently to promote the increase in dynamic pressure of said gaseous fluid during its entrainment by the compressor.

The compression ratio, i.e. the ratio between the pressure at the compressor outlet and the pressure at the inlet of said compressor, is thus improved by means of a first effect, which is mechanical in nature.

Secondly, excess injection of refrigerant substance, and especially of water, makes it possible to obtain a second effect, which is thermal in nature: since only part of said refrigerant substance vaporizes (or sublimes) during compression, the process makes it possible to exploit not only the latent heat of said refrigerant substance, during the change of state of the portion of refrigerant substance that vaporizes (or sublimes), but also the specific heat of said refrigerant substance, during the heating of the portion of refrigerant substance that remains in the condensed state.

This advantageously makes it possible to obtain quasi-isothermal compression.

The fineness of the particles (or droplets) advantageously contributes in this respect toward improving the quality and homogeneity of the heat exchanges.

In practice, the accumulation of the abovementioned thermal and mechanical effects, according to the process in accordance with the invention, makes it possible to significantly increase the efficiency of the compressor, by obtaining stage compression ratios that are markedly superior to those commonly observed.

In practice, the experimental results make it possible to observe a 5% increase in the compression ratio.

Other subjects, characteristics and advantages of the invention will emerge in greater detail on reading the description that follows, and also with the aid of the attached drawing, given for purely illustrative purposes and without limitation, and such that:

FIG. 1 represents a schematic view of an installation for performing a process in accordance with the invention.

The present invention relates to a process for compressing a gaseous fluid 1.

Said gaseous fluid 1 may be formed from a single gas, or alternatively from a mixture of several gases.

Preferentially, said gaseous fluid to be compressed will be formed of air, as is mentioned for purely illustrative purposes in FIG. 1.

Needless to say, the process is applicable to other gases, such as dinitrogen.

According to the invention, a process as described herein is envisaged.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

The FIGURE represents a process flow diagram in accordance with an embodiment of the present invention.

DETAILED DESCRIPTION

According to the invention, the process comprises a step (a) of injecting refrigerant, during which a refrigerant substance 3 is sprayed into the gaseous fluid 1 to be compressed, followed by a compression step (b), during which said gaseous fluid 1 charged with refrigerant substance 3 is forced to pass through said compressor 2 so as to compress said gaseous fluid.

The refrigerant substance 3 will preferably be injected upstream of the compressor 2, as is illustrated in FIG. 1.

That being said, it is not excluded, as a variant, to inject said refrigerant substance 3 into a section of the compression circuit located downstream of the inlet of the compressor 2, but, nevertheless, upstream of the outlet of the compressor 2, provided that said refrigerant substance 3 is present in the gaseous fluid 1 when said gaseous fluid 1 is (still) subjected to all or part of the effective action of the compressor 2.

By way of example, the refrigerant substance may thus be injected into the impeller of the compressor 2, in the case of a centrifugal compressor.

According to the invention, the mass delivery rate Q3 of the refrigerant substance 3 injected into the gaseous fluid represents between 1% and 5% of the mass delivery rate Q1 of the gaseous fluid 1 to be compressed, i.e.: $0.01 \times Q1$ [kg/s]$\leq$Q3 [kg/s]$\leq 0.05 \times$ Q1 [kg/s].

Preferably, the mass delivery rate Q3 of the refrigerant substance 3 will thus be less than or equal to, or even strictly less than, 5% of the mass delivery rate Q1 of the gaseous fluid 1 to be compressed, and preferentially greater than or equal to, or even strictly greater than, 1% of said mass delivery rate Q1 of the gaseous fluid 1 to be compressed.

By way of example, said mass delivery rate Q3 of refrigerant substance may be equal to, or between, 2% and 3%, or even 4%, depending on the adjustment value that will make it possible to obtain the best performance.

In addition, still according to the invention, the refrigerant substance 3 is sprayed in the form of particles with a maximum size of less than or equal to 25 μm.

Preferably, the particles of refrigerant substance 3 will have a maximum size of less than or equal to 10 μm and, as a preferential example, of the order of 5 μm.

More particularly, if the particles of refrigerant substance are likened to spheres or spherical droplets, their diameter will be less than or equal to the abovementioned values.

Needless to say, use may be made of any atomizer 7 or sprayer that is suitable for creating said particles of suitable size and for injecting them, in the desired amount, into the gaseous fluid 1 to be compressed.

Needless to say, it remains possible to inject the refrigerant substance 3 in an even finer form, for example in the form of particles with a size of less than 5 μm, or even 2 μm.

Advantageously, as has been indicated above, the creation, preferably upstream of the compressor, of a gaseous fluid 1 charged with refrigerant substance 3, forming a two-phase medium that is both homogeneous and denser than the gaseous fluid alone, is particularly favorable not only for capturing and evacuating by means of the refrigerant substance 3 the heat produced by the compression, and consequently for obtaining quasi-isothermal compression, but also for the dynamic compression of the charged fluid.

Advantageously, by injecting an amount of refrigerant substance 3 that is suitably dosed with regard to the amount of gaseous fluid 1 to be treated, the heat extraction is optimized, in particular due to the fact that, on account of the excess dosing of refrigerant substance initially present in a condensed state (liquid or solid), only some of said refrigerant substance 3 changes state, and more particularly vaporizes or sublimes, during the compression, which makes it possible to exploit not only the latent heat of the refrigerant substance 3, during the change of state of the portion of refrigerant substance concerned, but also the specific heat of said refrigerant substance, during the heating of the portion of refrigerant substance that remains in the condensed state.

Any suitable refrigerant substance 3, and more particularly any substance that is capable of performing a phase change, in the present case a partial change, during compression to capture heat may be suitable for use.

According to a preferential implementation variant, the refrigerant substance 3 is predominantly, and preferably exclusively, formed of water, and more particularly of water droplets injected in liquid form.

This water is preferably demineralized before being introduced into the cooling circuit.

Injection of water at the compressor 2 inlet, in the form of liquid micro-droplets, constitutes a simple means for increasing the density of the charged fluid to be compressed, as has been stated hereinabove, and to maximize the evacuation of heat.

It would also be envisageable to inject the water in the form of solid ice particles, or else to use, alone or in combination with water, another refrigerant substance that is initially in solid form.

Thus, according to a possible implementation variant, the refrigerant substance 3 may contain, where appropriate predominantly or even exclusively, water ice or dry ice, injected in the form of solid particles.

Dry ice may advantageously capture the heat evolved by the compression of the gaseous fluid 1 by at least partially subliming during said compression.

Moreover, the compression is preferably performed by means of a dynamic compressor 2, and more particularly by means of a centrifugal compressor 2 (or "radial compressor").

The term "dynamic compressor" denotes, as opposed to "volumetric" compressors in which the reduction of a closed volume of gas is forced in order to increase its pressure, a compressor 2 which makes it possible to obtain a pressure increase by adding kinetic energy to a continuous jet of fluid, by means of a rotor or a compression stage, said kinetic energy thus acquired then being transformed into an increase in static pressure by curbing the flow through a diffuser.

Such a dynamic compression mode is in fact particularly suitable for the acceleration and dynamic compression of the relatively dense two-phase fluid created by the addition, to the gaseous fluid 1, of the refrigerant substance 3 in the proportions and under the conditions envisaged by the invention.

The process comprises a step (c) of recycling the refrigerant substance, during which the refrigerant substance 3 is separated from the gas stream 1 exiting the compressor 2, by means of a separator 4 such as a condenser or a mist eliminator, so as to recover at least some, preferably most, or even all, of said refrigerant substance 3.

Said refrigerant substance 3 thus collected may then advantageously be reinjected into the compressor 2, and preferably into the inlet of said compressor 2, during step (a) of injecting refrigerant substance.

The refrigerant substance 3 thus collected and recycled will preferably be cooled before being reinjected into the compressor.

Advantageously, recycling makes it possible to achieve substantial savings in refrigerant substance 3, and more particularly to considerably reduce the water consumption of the installation in which the process is performed.

With regard especially to the charged two-phase nature of the treated fluid, and the high dynamic pressure prevailing at the outlet of the compressor 2, it will be preferred to use a mist eliminator for mechanical separation of the refrigerant substance 3 by inertia by means of plates or chicanes, rather than to use (which is nevertheless possible, or even combinable with the preceding) a heat-reclaim condenser.

Preferably, during the recycling step (c), some of the atmospheric water that was initially contained in the air (in the gaseous fluid 1) and that was condensed during compression or following said compression is recovered, and this atmospheric water is used to purge, which is symbolized by a drain valve 6 in FIG. 1, the impurities from the recycling circuit 5.

Advantageously, since the amount of water withdrawn by the separator 4 exceeds the amount of water initially added as refrigerant substance 3 upstream of the compressor 2, the difference, which corresponds to the volume of atmospheric water freed of the compressed air, may be used as rinsing liquid for the recycling circuit 5.

Since the recycling of the refrigerant substance 3 is thus complete, without loss, the water consumption after launching the process is advantageously virtually zero.

According to an implementation variant of the process, which may constitute a fully-fledged invention, the gaseous fluid 1 to be compressed is formed of dinitrogen, and the refrigerant substance 3 of liquid nitrogen, advantageously injected in the form of droplets.

Preferably, the stage compression ratio of the compressor 2, i.e. the ratio between the pressure at the compressor outlet and the pressure at the compressor inlet, may be greater than 2, than 2.5 or even substantially equal to or greater than 5.

The invention makes it possible in this respect to significantly increase the performance of the compressor, to the extent that it becomes possible to achieve, in a single compression stage, compression operations that hitherto required several successive compressor stages.

For example, a compressor 2 operating according to the invention makes it possible to obtain, with an inlet pressure of the order of 1 bar (atmospheric pressure), an outlet pressure of the order of 5 bar to 6 bar with two compression stages instead of the usual three.

In addition, the temperature increase (relative to the inlet ambient temperature) brought about by the compression is very largely contained by the cooling, and may in particular remain below +50° C.

Experimentally, it was found that the invention makes it possible, for a constant impeller size of the compressor 2, and relative to functioning without injection of refrigerant substance, to increase the compression ratio by the order of 2% to 5% for a given delivery rate Q1 of gaseous fluid 1, or, conversely, to increase the delivery rate Q1 of treated gaseous fluid 1 by 2% to 5% at a given constant compression ratio, which affords a gain in productivity.

By way of example, tests were conducted on a compressor sucking up a gaseous fluid of air type at 1.013 bar and 15° C., and producing a compression ratio of 1.8. The maximum diameter of the water droplets used as refrigerant substance 3 was 5 μm, and the mass delivery rate Q3 of said refrigerant substance 3 represented 2% of the mass delivery rate Q1 of the gaseous fluid to be compressed.

The outlet temperature was in the region of 70° C.

Such a compressor offered an operating range from Q1=1000 $m^3$/h to Q1=2000 $m^3$/h.

The increase in compression ratio could be up to 5%, and was globally between 2% and 5% over said operating range.

Regarding this last point, it will be noted that, advantageously, the invention makes it possible to significantly increase the compression ratio of the compressor 2 over its entire operating range, from the minimum delivery point, known as the "pumping point", below which the compressor can no longer function stably, to the maximum delivery point, obtained when said compressor functions with low downstream resistance.

As a guide, the envisaged operating ranges, i.e. the delivery rates Q1 of gaseous fluid 1 treated by the compressor 2, may especially range from 50 000 $m^3$/h to 100 000 $m^3$/h.

More globally, said operating ranges may be between 5000 $m^3$/h and 500 000 $m^3$/h (i.e. they may correspond to any interval, irrespective of its breadth, which is strictly contained between these two extreme values), or even integrally cover a range that extends, preferably continuously, from 5000 $m^3$/h to 500 000 $m^3$/h.

Needless to say, these individual compression stage efficiencies do not exclude that it is optionally possible to implement several compression stages in series, each repeating all or some of the steps of the process in accordance with the invention.

Needless to say, the invention also relates to an installation for compressing gaseous fluid, and especially an installation for producing compressed air, arranged to perform the process in accordance with the invention.

The invention in particular relates to installations that are capable of treating a large delivery rate of gaseous fluid 1 to be compressed, of the order of $10^4$ $m^3$/h to $10^6$ $m^3$/h.

It will also be noted that the process in accordance with the invention is particularly suited to installations for separating air gases (air separation units).

Needless to say, the invention is, however, in no way limited to the described variants, and a person skilled in the art is especially capable of freely isolating or combining the various features mentioned in the foregoing.

While the invention has been described in conjunction with specific embodiments thereof, it is evident that many alternatives, modifications, and variations will be apparent to those skilled in the art in light of the foregoing description.

Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A process for compressing a gaseous fluid, the process comprising the steps of:

(a) injecting refrigerant, during which a refrigerant substance is sprayed into the gaseous fluid to be compressed; and (b) a compression step, during which said gaseous fluid charged with refrigerant substance is forced to pass through a compressor so as to compress said gaseous fluid, the mass delivery rate (Q3) of the refrigerant substance injected into the gaseous fluid representing between 1% and 5% of the mass delivery rate of the gaseous fluid to be compressed, and the refrigerant substance being sprayed in the form of particles with a maximum size of less than or equal to 25 μm; and (c) of recycling the refrigerant substance during which the refrigerant substance is separated from the gas stream exiting the compressor, by means of a separator so as to recover at least some of said refrigerant substance, wherein the at least some of said refrigerant substance is reinjected into said compressor, during step (a) of injecting substance.

2. The process as claimed in claim 1, wherein the particles of refrigerant substance have a maximum size of less than or equal to 10 μm.

3. The process as claimed in claim 1, wherein the refrigerant substance is formed predominantly of water.

4. The process as claimed in claim 1, wherein the refrigerant substance is formed of water droplets injected in liquid form.

5. The process as claimed in claim 1, wherein the refrigerant substance contains water ice or dry ice, injected in the form of solid particles.

6. The process as claimed in claim 1, wherein the means of the separator is selected from the group consisting of a condenser and a mist eliminator.

7. The process as claimed in claim 1, wherein during step (c), all of the refrigerant substance is recovered.

8. The process as claimed in claim 1, wherein the gaseous fluid to be compressed is air.

9. The process as claimed in claim 8, wherein some atmospheric water initially contained in the air and condensed during compression is recovered during the recycling step (c), and the recovered atmospheric water is used to purge the impurities from the recycling circuit.

10. The process as claimed in claim 1, wherein the gaseous fluid to be compressed is formed of dinitrogen, and in that the refrigerant substance is formed of liquid nitrogen.

11. The process as claimed in claim 1, wherein the compression is performed by means of a centrifugal compressor.

12. The process as claimed in claim 1, wherein the compression is performed by a plurality of compression stages, wherein a compression ratio per compressor stage is greater than 2.

13. The process as claimed in claim 1, wherein the compression is performed by a plurality of compression stages, wherein a compression ratio per compressor stage is greater than 2.5.

14. The process as claimed in claim 1, wherein the compression is performed by a plurality of compression stages, wherein a compression ratio per compressor stage is substantially equal to or greater than 5.

15. The process as claimed in claim 1, wherein the delivery rate of gaseous fluid treated by the compressor is between 5,000 $m^3/h$ and 500,000 $m^3/h$.

16. The process as claimed in claim 1, wherein the delivery rate of gaseous fluid treated by the compressor is between 50,000 $m^3/h$ and 100,000 $m^3/h$.

17. The process as claimed in claim 1, wherein the separator is a condenser.

18. The process as claimed in claim 1, wherein the separator is a mist eliminator.

* * * * *